US008236167B2

(12) United States Patent
Lacerenza

(10) Patent No.: US 8,236,167 B2
(45) Date of Patent: Aug. 7, 2012

(54) LUBRICATING OIL

(75) Inventor: D. Matthew Lacerenza, Stamford, CT (US)

(73) Assignee: Liquifix, Stamford, CT (US)

( * ) Notice: Subject to any disclaimer, the term of this patent is extended or adjusted under 35 U.S.C. 154(b) by 343 days.

(21) Appl. No.: 12/620,682

(22) Filed: Nov. 18, 2009

(65) Prior Publication Data

US 2011/0114537 A1 May 19, 2011

(51) Int. Cl.

| | |
|---|---|
| ***C10M 111/02*** | (2006.01) |
| ***C10M 169/02*** | (2006.01) |
| ***C10M 101/02*** | (2006.01) |
| ***C10M 171/00*** | (2006.01) |

(52) U.S. Cl. ..... 208/19; 585/1; 585/13

(58) Field of Classification Search ..... 585/1, 13; 208/268, 18–19; 508/110

See application file for complete search history.

(56) References Cited

U.S. PATENT DOCUMENTS

| | | | | |
|---|---|---|---|---|
| 1,920,161 | A * | 7/1933 | Rosen | 208/19 |
| 2,758,088 | A | 8/1956 | Bartlett et al. | |
| 3,623,983 | A | 11/1971 | Pattenden et al. | |
| 5,362,411 | A | 11/1994 | Bergstra et al. | |
| 5,534,173 | A | 7/1996 | Faber et al. | |
| 5,888,948 | A | 3/1999 | Meny et al. | |
| 5,958,850 | A | 9/1999 | Matsuzaki et al. | |
| 6,610,634 | B1 | 8/2003 | Tiffany, III et al. | |
| 2004/0102562 | A1 | 5/2004 | Butuc | |
| 2005/0272614 | A1 | 12/2005 | Walker et al. | |

* cited by examiner

*Primary Examiner* — James Goloboy
*Assistant Examiner* — Pamela H Weiss
(74) *Attorney, Agent, or Firm* — Bachman & LaPointe, P.C.

(57) ABSTRACT

A lubricating oil composition having a wide variety of uses consists of a dearomatized hydrocarbon distillate (petroleum), a post lubricant petroleum hydrocarbon, and white mineral oil. In one embodiment, the dearomatized hydrocarbon distillate is present in an amount from 15 to 25%, the post lubricant petroleum hydrocarbon is present in an amount from 5 to 15%, and the balance is the white mineral oil.

15 Claims, No Drawings

LUBRICATING OIL

BACKGROUND (1) Field of the Invention

The present invention relates to a lubricating oil product which may be used for a wide variety of purposes.

(2) Prior Art

Many different lubricating oil compositions are known in the art. For example, the product sold under the trade name WD-40 is a well known lubricating oil.

U.S. Pat. No. 2,758,088 to Barlett et al. relates to a penetrating oil composition which comprises a mineral oil base stock containing a minor amount of a material having the formula $RCH(XR')_2$ where R and R' are alkyl radicals having from 4 to 18 carbon atoms and where X is selected from the class of oxygen and sulfur.

U.S. Pat. No. 3,623,983 to Pattenden et al. relates to a penetrating oil composition having from 50 to 85 weight percent of a refined mineral base oil, from about 10 to 25 wt % of a paraffinic distillate solvent oil, from about 4 to 25 wt % of a mixture of metal hydrocarbon sulfonate and aliphatic carboxylic acids of oxidized hydrocarbon wax, and about 0.5 to 25 wt % of a phosphate ester selected from the group consisting of a monoester, a diester, and mixtures thereof, of phosphoric acid with an alkoxylated long chain aliphatic alcohol wherein the aliphatic radical contains at least 12 carbon atoms per molecule and the alkoxylating is carried out using from 1 to 6 moles of a $C_2$ to $C_3$ alkylene oxide per mole of alcohol.

Published U.S. patent application no 2005/0272614 to Walker relates to a penetrant and coating composition concentrate for metals having improved corrosion inhibiting properties. The composition includes from about 2 to about 5 wt % of ashless acidic rust inhibitor, from about 25 to about 50 weight percent neutral alkaline earth metal sulfonate corrosion inhibitor component, from about 25 to about 50 weight percent phosphorous base corrosion inhibitor component, and a process oil component.

U.S. Patent Publication No. 2004/0102562 to Butuc relates to a composition of matter comprising at least one hydrocarbon base fluid mixed with at least one diblock copolymer, said copolymer being present in sufficient concentration for the composition to exhibit shear stresses that are a non-linear function of the fluid strain rate.

Still other lubricating oil compositions are shown in U.S. Pat. No. 6,610,634 to Tiffany III, U.S. Pat. No. 5,958,850 to Matsuzaki et al.; U.S. Pat. No. 5,888,948 to Meny; U.S. Pat. No. 5,534,173 to Faber; and U.S. Pat. No. 5,362,411 to Bergstra.

Still another lubricating oil composition is one which has been sold under the tradename LIQUIFIX.

SUMMARY OF THE INVENTION

In accordance with the instant disclosure, there is discloses a lubricating oil having a composition consisting of a dearomatized hydrocarbon distillate (petroleum), a post lubricant petroleum hydrocarbon, and white mineral oil. In one embodiment, the dearomatized hydrocarbon distillate is present in an amount from 15 to 25%, the post lubricant petroleum hydrocarbon is present in an amount from 5 to 15%, and the balance is the white mineral oil.

Further, in accordance with the instant disclosure, there is disclosed a lubricating oil composition which has a flash point greater than 220° F., a specific gravity at 25° C. of 0.8605, and a viscosity of 150 cSt.

Still further, in accordance with the instant disclosure, there is provided a process for lubricating an object, said process broadly comprising the steps of: providing a lubricating oil composition consisting of a dearomatized hydrocarbon distillate (petroleum), a post lubricant petroleum hydrocarbon, and white mineral oil; and applying said lubricating oil composition to a surface of said object.

Other details of the lubricating oil of the present invention, as well as other objects and advantages attendant thereto are set forth in the following detailed description.

DETAILED DESCRIPTION OF THE PREFERRED EMBODIMENT(S)

As discussed above, the lubricating oil composition of the present invention consists of a dearomatized hydrocarbon distillate (petroleum), a post lubricant petroleum hydrocarbon, and white mineral oil.

The dearomatized hydrocarbon distillate (petroleum) may be any suitable distillate known in the art, such as one sold under the tradename EXXSOL D110 manufactured by Exxon Mobil/Hubbard-Hall Inc. EXXSOL D110 is a dearomatized hydrocarbon distillate (petroleum) which has been hydrotreated light and which has a flash point greater than 105° C. (221° F.) and an autoignition temperature of 243° C. (469° F.). EXXSOL D110 is a clear liquid which is colorless and which has a density at 15° C. of 809 kg/m$^3$; a boiling point in the range of from 237 to 277° C.; and a viscosity of 2.54 cSt at 40° C.

The post lubricant petroleum hydrocarbon may be any suitable hydrocarbon known in the art, such as one sold under the tradename APO-55 by the D.A. Stuart Company. APO-55 has a flashpoint of 270° F. and a specific gravity of 0.900. It is a clear amber liquid product. The inclusion of the post lubricant petroleum hydrocarbon is desirable because it enhances the corrosion control properties of the composition.

The white mineral oil may be any suitable mineral oil known in the art, such as one sold under the tradename DRAKEOIL 350 by Calumet/Penreco.

The aforementioned constituents of the lubricating oil composition may be mixed together using any suitable technique known in the art.

In one embodiment of the lubricating oil composition of the present invention, the dearomatized hydrocarbon distillate is present in an amount from 15 to 25%, the post lubricant petroleum hydrocarbon is present in an amount from 5 to 15%, and the balance is the white mineral oil. In a most preferred embodiment, the dearomatized hydrocarbon is present in an amount from 19 to 21%, the post lubricant petroleum hydrocarbon is present in an amount from 9 to 11%, and the balance is the white mineral oil.

It has been found that lubricating oil compositions in accordance with the present invention have a flash point greater than 220° F., and in a preferred embodiment about 275° F. Still further, the lubricating oil compositions in accordance with the present invention has a relatively high dielectric breakdown voltage of 35 KV as measured by ASTM D 877. The lubricating oil composition of the present invention is odorless, non-staining, and has no electrostatic charge which attracts dust. Further, it has a long lasting shelf life.

Still further the lubricating oil compositions of the present invention has the following physical data:

| | |
|---|---|
| Specific gravity @ 25° C. | 0.8605 |
| Refractive Index | 1.4598 |
| Boiling point (initial | 450° F./232° C. |
| Volatile, % by volume | 24.23 |
| Evaporation Rate (n-butyl acetate = 1) | 1.1 |
| Vapor Pressure (mm Hg @ 20° C.) | 1.0 |
| Vapor Density | less than 1.0 |
| Solids, % by weight | 90.63 |
| Viscosity, cSt | 150 |
| VOC (Volatile Organic Compounds) g/L | 77 |
| Solubility in water | Negligible |

The lubricating oil compositions of the present invention may be applied without having to use an aerosol. It may be applied using a pump spray, a squeeze bottle, etc. There is no need for pressure. The lubricating oil compositions of the present invention may also be applied by an oil can and a brush.

The lubricating oil compositions of the present invention has many applications in such areas as auto & motor sports applications; boating applications; farming applications; garage/workshop applications; hobby and crafts applications; and home & garden applications. For example, the composition can be used to provide a protective coat to snow chains; prevent rust on and lubricate snowblower chutes; winterize the undercarriage of cars to help prevent salt damage; prevent snowmobile runners from corrosion and rust damage; keep door handles from freezing; provides a protective coating on metal objects to prevent rust from forming; lubricates and penetrates stuck objects; displaces moisture from car wiring; eases removal of stuck spark plugs from an engine; restores vintage door locks; cleans and protects brake mechanisms; protects electrical connections in engines; prevents oxidation on battery connections; lubricates trunk latches; lubricates cover top zippers, removes barnacles from boat hulls; loosens lug nuts; loosens frozen parts; lubricates boat masts; lubricates tractor throttle cables; helps dissolve rust; shines steel; protects hammers from rust and corrosion; cleans and lubricates tools, saws, and blades; lubricates garage door tracks; keeps model trains rust-free; cleans metal figurines; lubricates molds; coats snow shovels; cleans gardening tools and implements; cleans old coins; and cleans and lubricates moving parts.

A test was conducted to provide comparative reactions under the same conditions. Three stages of heat and air contact to provide percent solids, evaporation and dry film texture (of the solid residue). The products tested were the lubricating oil of the present invention (Product A), WD-40® lubricant, LIQUID WRENCH® lubricant, and JIG-A-LOG® lubricant. The following was found:

| Percent Solids on Evaporation, Active Lubricity | | | | |
|---|---|---|---|---|
| Temp./Hrs | Product A | WD-40 | LIQUID WRENCH | JIG-A-LOO |
| 70° F./2 | 99.7 | 88.0 | 0 | 7.1 |
| 85° F./2 | 99.4 | 77.3 | — | 6.1 |
| 100° F./2 | 98.9 | 53.8 | — | 5.2 |

The above results show that increased temperature provides less active lubrication for three of the tested products. Though Product A (the lubricating oil of the present invention) and WD-40® have long lasting lubricity, Product A has far greater lubrication for longer periods under varying temperatures.

| Residual Lubricity (solids) By Drying Air | | | | |
|---|---|---|---|---|
| Time | Product A | WD-40 ® | LIQUID WRENCH ® | JIG-A-LOO ® |
| 168 Hrs. | 95.7 | 34.5 | 3.9 | 0.59 |

The above results show that the product of the present invention has more retention qualities regarding lubricity than the other products.

Film Texture: The lubricating oil composition of the present invention has an oily film that provides lubrication. WD-40® has an oily film that provides lubrication. LIQUID WRENCH® has a dry powdery film with slight if any lubrication quality. JIG-A-L00® has a film that is sticky and gummy.

As can be seen from the foregoing, the lubricating oil composition of the present invention offers greater and longer lasting lubrication under extreme heat changes as well as room temperature. This helps in stability when being used during summer months, moving tool parts (hedge trimmers, etc.). Before using and after using of tools, the lubricating oil composition of the present invention would keep them lubricated until the next use. The lubricating oil composition of the present invention is not flammable, whereas the comparative test products which were tested are flammable.

An ASTM D-4172 Four Ball Wear Test was performed using the lubricating oil composition of the present invention. The result was 0.76 mm. An ASTM d-3825 surface tension test was performed using the lubricating oil composition of the present invention. The result was 30.33 dynes/cm. An ASTM D-3233-B falex pin and V Block test was performed using the lubricating oil composition of the present invention. The result of this test was as follows:

| Load | Starting Torque | Final Torque |
|---|---|---|
| 300 lbs @ 5 min. | 6 lbs/in. | 8 lbs/in. |
| 500 lbs @ 1 min. | 15 lbs/in. | 16 lbs/in. |
| 750 lbs @ 1 min. | 20 lbs/in. | 19 lbs/in. |
| *1000 lbs @ 1 min. | 35 lbs/in. | *comment |

*Final torque spiked to 70 lbs/in. and load progressively dropped within 20 seconds.

As can be seen from the foregoing results, the lubricating oil composition of the present invention performed satisfactorily in these tests.

The lubricating oil composition of the present invention is safe to use, can be removed by washing with soap and water, and does not contain any cancer agents.

It is apparent that there has been provided a lubricating oil composition which has many uses. While the lubricating oil composition has been described in the context of specific embodiments thereof, other alternatives, modifications and variations may become apparent to those skilled in the art having read the foregoing description. Accordingly, it is intended to embrace those unforeseen alternatives, modifications, and variations as fall within the broad scope of the appended claims.

What is claimed is:

1. A lubricating oil composition consisting of a petroleum derived dearomatized hydrocarbon distillate, a post lubricant petroleum hydrocarbon, and white mineral oil.

2. The lubricating oil composition of claim 1, wherein the dearomatized hydrocarbon distillate is present in an amount from 15 to 25%, the post lubricant petroleum hydrocarbon is present in an amount from 5 to 15%, and the balance is the white mineral oil.

3. The lubricating oil composition of claim 1, wherein the dearomatized hydrocarbon distillate is present in an amount from 19 to 21%, the post lubricant petroleum hydrocarbon is present in an amount from 9 to 11%, and the balance is the white mineral oil.

4. The lubricating oil composition of claim 1, wherein the lubricating oil composition has a flash point greater than 220° F.

5. The lubricating oil composition of claim 1, wherein the lubricating oil composition has a flash point of approximately 270° F.

6. The lubricating oil composition of claim 1, wherein the lubricating oil composition has a dielectric breakdown voltage of 35 KV.

7. The lubricating oil composition of claim 1, wherein said composition is non-flammable.

8. A lubricating oil composition comprising a white mineral oil based composition, and said composition having flash point greater than 220° F. and a specific gravity at 25° C. of 0.8605.

9. The lubricating oil composition of claim 8, wherein said composition consists of a petroleum derived dearomatized hydrocarbon distillate, a post lubricant petroleum hydrocarbon, and white mineral oil.

10. The lubricating oil composition of claim 9, wherein the dearomatized hydrocarbon distillate is present in an amount from 15 to 25%, the post lubricant petroleum hydrocarbon is present in an amount from 5 to 15%, and the balance is the white mineral oil.

11. The lubricating oil composition of claim 9, wherein the dearomatized hydrocarbon distillate is present in an amount from 19 to 21%, the post lubricant petroleum hydrocarbon is present in an amount from 9 to 11%, and the balance is the white mineral oil.

12. The lubricating oil composition of claim 8, wherein said composition has a refractive index of 1.4598, an initial boiling point of 450° F., a vapor density of less than 1.0, and a negligible solubility in water.

13. A process for lubricating an object, said process comprising the steps of:

providing a lubricating oil composition consisting of a petroleum derived dearomatized hydrocarbon distillate, a post lubricant petroleum hydrocarbon, and white mineral oil; and applying said lubricating oil composition to a surface of said object.

14. The process of claim 13, wherein said providing step comprises providing a lubricating oil composition wherein the dearomatized hydrocarbon distillate is present in an amount from 15 to 25%, the post lubricant petroleum hydrocarbon is present in an amount from 5 to 15%, and the balance is the white mineral oil.

15. The process of claim 13, wherein said providing step comprises providing a lubricating oil composition wherein the dearomatized hydrocarbon distillate is present in an amount from 19 to 21%, the post lubricant petroleum hydrocarbon is present in an amount from 9 to 11%, and the balance is the white mineral oil.

* * * * *